US008946625B2

(12) United States Patent
Nikolaev et al.

(10) Patent No.: US 8,946,625 B2
(45) Date of Patent: Feb. 3, 2015

(54) INTRODUCTION OF IONS INTO A MAGNETIC FIELD

(75) Inventors: Evgenij Nikolaev, Moscow (RU); Jochen Franzen, Bremen (DE)

(73) Assignee: Bruker Daltonik GmbH, Bremen (DE)

( * ) Notice: Subject to any disclaimer, the term of this patent is extended or adjusted under 35 U.S.C. 154(b) by 851 days.

(21) Appl. No.: 12/056,630

(22) Filed: Mar. 27, 2008

(65) Prior Publication Data

US 2008/0251715 A1 Oct. 16, 2008

(30) Foreign Application Priority Data

Apr. 12, 2007 (DE) ..... 10 2007 017 236

(51) Int. Cl.

| | |
|---|---|
| ***H01J 49/00*** | (2006.01) |
| ***G21K 1/093*** | (2006.01) |
| ***H01J 49/06*** | (2006.01) |
| ***H01J 49/38*** | (2006.01) |

(52) U.S. Cl.

CPC ..... *G21K 1/093* (2013.01); *H01J 49/065* (2013.01); *H01J 49/38* (2013.01)

USPC ..... 250/288; 250/281

(58) Field of Classification Search

None

See application file for complete search history.

(56) References Cited

U.S. PATENT DOCUMENTS

| | | | | |
|---|---|---|---|---|
| 4,535,235 A | | 8/1985 | McIver, Jr. | |
| 5,572,035 A | * | 11/1996 | Franzen | 250/396 R |
| 5,965,884 A | | 10/1999 | Laiko et al. | |
| 6,188,219 B1 | * | 2/2001 | Reeder et al. | 324/307 |
| 6,680,477 B2 | | 1/2004 | Beck et al. | |
| 6,720,555 B2 | * | 4/2004 | O'Connor | 250/291 |
| 7,385,192 B2 | | 6/2008 | Haase et al. | |
| 7,388,197 B2 | * | 6/2008 | McLean et al. | 250/293 |
| 7,880,136 B2 | * | 2/2011 | Makarov et al. | 250/282 |
| 2003/0127592 A1 | * | 7/2003 | O'Connor | 250/291 |
| 2004/0119014 A1 | * | 6/2004 | Mordehai | 250/290 |
| 2004/0155180 A1 | * | 8/2004 | Zubarev | 250/281 |
| 2004/0217284 A1 | * | 11/2004 | Malek et al. | 250/291 |
| 2005/0098718 A1 | * | 5/2005 | O'Connor | 250/286 |
| 2006/0024720 A1 | * | 2/2006 | McLean et al. | 435/6 |
| 2007/0278400 A1 | | 12/2007 | Schurenberg et al. | |
| 2010/0259259 A1 | * | 10/2010 | Zahn et al. | 324/309 |

FOREIGN PATENT DOCUMENTS

| | | |
|---|---|---|
| DE | 103 29 674 A1 | 2/2005 |
| DE | 10 2004 044 196 A1 | 3/2006 |

(Continued)

OTHER PUBLICATIONS

Dreisewerd, Klause, "The Desorption Process in MALDI", Chem. Rev., vol. 103, 2003, S. 395-425.

*Primary Examiner* — Andrew Smyth

(74) *Attorney, Agent, or Firm* — Robic, LLP

(57) ABSTRACT

In a mass spectrometer that uses a space-restricted magnetic field, such as an ion cyclotron resonance mass spectrometer, ions with a wide mass range generated in an ion supply located outside the magnetic field are transported in the direction of the magnetic field lines to an ion storage device located inside the magnetic field without losing ions by guiding the ions through the region in which the magnetic field strength increases with a special ion guide. This ion guide consists of an arrangement of coaxial ring diaphragms which are alternately supplied with the phases of an RF voltage. In an alternative embodiment, the ion guide uses two wires wound in a double helix where each wire is supplied with one phase of a two-phase RF voltage.

7 Claims, 3 Drawing Sheets

(56) References Cited

FOREIGN PATENT DOCUMENTS

| | | | |
|---|---|---|---|
| EP | 1 315 196 | A2 | 5/2003 |
| GB | 2 378 312 | A | 2/2003 |
| WO | WO 01/13100 | A2 | 2/2001 |
| WO | WO 2007080857 | A1 * | 7/2007 |

* cited by examiner

INTRODUCTION OF IONS INTO A MAGNETIC FIELD

BACKGROUND

The invention relates to the true-to-quantity introduction of ions of a wide mass range into a very strong magnetic field in the direction of the magnetic field lines to an ion storage device, for example: a measuring cell in an ion cyclotron resonance mass spectrometer. The development of magnetic field generators with superconducting solenoids for very strong magnetic fields is advancing very rapidly. This type of magnet is used both for nuclear magnetic resonance spectrometry (NMR) and also for ion cyclotron resonance mass spectrometry (ICR-MS). For the latter, magnets with field strengths of 7, 9, 12 and 15 Tesla are now available and supplied. Instruments with 21 Tesla magnets are planned. Several of the performance specifications for ICR mass spectrometers increase linearly with the field strength. Some other important performance specifications, such as the resolution or the ion collection capacity of the measuring cells without interfering with the scan, even increase with the square of the field strength, making it easy to understand why researchers are trying to achieve higher field strengths.

Every magnet for an ICR mass spectrometer has a so-called open bore (also called "room-temperature bore"), usually with a diameter of around eleven centimeters, which allows access to the inner region with the highest and most homogeneous field strength. The axis of the bore coincides with the axis of the magnetic field. A long, tubular vacuum recipient, which contains the measuring cell for analyzing the ions in the form of an ion storage device, is inserted into this bore. The aim of the investigations is usually to determine the mass of the ions, which is obtained by measuring the circular cyclotron motions which an ion assumes after appropriate excitation. A very good vacuum of better than $10^{-6}$ Pascal is required to keep the ions moving freely and without collisions over periods of several seconds.

In the past, magnets of this type were passively shielded by several layers of thick iron sheets, which meant that 12 Tesla magnets weighed more than 15 tons. Nowadays such magnets use active shielding. This means that an inner coil system and an outer coil system are used to feed most of the field lines of the magnetic field of the inner solenoid back through the outer coil system, thus producing only very small magnetic fringe fields at the entrances and exits of the bores. This gives a very steep magnetic field increase at the entrance of the magnet. The superconducting coils are located in helium cryostats, which, in turn, are usually enclosed in liquid nitrogen cryostats. The walls of the bores are at room temperature; the magnets are therefore technically very complex to manufacture.

The steep increase of the magnetic field leads to difficulties when introducing the ions, which are generated outside the magnetic field and introduced into it. Only ions which are injected exactly on the axis of the magnetic field and its fringe field have a chance of reaching the measuring cell; all other ions injected either at a slight angle or slightly off-axis are reflected by the fringe field as if they were in a magnetic bottle. Asymmetric distortions of the fringe field mean that no ions at all can be injected. Unless special measures are taken, it sometimes requires several days of adjustments until an alignment of the recipient to the magnet is achieved which allows a satisfactory number of ions to reach the measuring cell. This adjustment has to be repeated after each new insertion of the recipient unless special measures are taken to maintain the alignment.

About two decades ago, a way of greatly simplifying this adjustment for magnets of medium field strength was described. This used an RF quadrupole rod system (R. T. McIver, U.S. Pat. No. 4,535,235). The system, consisting of four long pole rods, extends through the magnetic field increase to the measuring cell in the homogeneous magnetic field. The two phases of an RF voltage are applied alternately to the pole rods of the quadrupole system, in whose interior a radially focusing pseudopotential is produced. In this way, the ions can be more easily and reproducibly guided from the outside through the fringe field to the measuring cell.

If ions of a very wide mass range are to be transported more or less uniformly into the measuring cell, then it is favorable, according to recent research, to increase the number of poles when using magnets with higher magnetic field strengths, i.e., to change from quadrupole rod systems to hexapole, octopole, or even higher multipole systems. But even then, this ion guide does not work for very strong, short magnets, especially for light ions. Heavy ions are transported fairly satisfactorily, but many light ions do not arrive at the strong magnetic field.

Research has shown that the light ions are lost in the region of the magnetic field increase where their cyclotron frequency just equals the RF frequency of the pole rod system. The cyclotron motions of the ions are resonantly excited by the electric fields, which have components at right angles to the magnetic field lines inside the pole rod systems. As a result, the ions are moved out of the system until they collide with the pole rods. The RF fields can also excite harmonics of the ion motion, or the cyclotron motion of harmonics of the RF. In any case, no true-to-quantity transport of the ions of different masses takes place.

To achieve maximum sensitivity, the ions under investigation are usually collected in a temporary store outside the magnetic field and introduced into the magnetic field from this temporary store. The easiest method is to accelerate the ions simultaneously as an ion cluster from the temporary store, and to transfer them to the measuring cell. The capture of the ions in the ion storage device acting as a measuring cell in the magnetic field is greatly simplified if the ions of all masses enter with low energies and at the same time. The aim is to achieve entrance energies of approx. 0.3 electron-volts. The long path from the ion supply to the measuring cell, however, causes a temporal mass dispersion of the ion cluster which has been transferred, so that the ions arrive at the measuring cell separated according to their mass: first the lighter and faster ions, then increasingly the heavier ones. This temporal mass dispersion can be greatly reduced, but not eliminated, by strongly accelerating the ions from the temporary store and decelerating them before they enter the measuring cell. The large overall length of strong magnets, which represents a long flight path, therefore presents a further problem for a highly efficient, and also true-to-quantity, capture of the ions from the temporary store.

The greatest successes with ICR mass spectrometry have been achieved in the field of proteomics, and especially in the field of "top-down analysis" of proteomes, where the masses of hundreds or even thousands of digest peptides are simultaneously analyzed in the measuring cell and subsequently assigned to the undigested proteins of the proteomes. For reasons which are not yet fully understood, the larger the number of different types of ions in the measuring cell, the better the ICR mass spectrometry operates. Accuracies of much better than one millionth of the mass can be achieved in the mass determination; no other type of mass spectrometry can measure this accurately. This application (and also other methods in proteomics) works optimally when both the ions of individual, cleaved amino acids (so-called immonium ions) with masses from 50 Daltons upwards and peptides with mass-to-charge ratios of approximately 5,000 Daltons can be measured together. It should therefore be possible to introduce ions of the mass range of 1:100 into the measuring cell. The velocities of these ions extend over a range of 1:10 at the same kinetic energy. This data explains the problem for the true-to-quantity, efficient introduction of the ions into the measuring cell.

The term "mass" here always refers to the "mass-to-charge ratio" m/z, which is the only parameter of importance in mass spectrometry, and not simply to the "physical mass" m. The number z is the number of elementary charges, i.e., the number of excess electrons or protons which the ion possesses, which act externally as the ion charge. All mass spectrometers without exception can measure only the mass-to-charge ratio m/z, not the physical mass m itself. The mass-to-charge ratio is the mass fraction per elementary ion charge. The terms "light" and "heavy" ions here analogously refer to ions with a low and high mass-to-charge ratio m/z respectively. Similarly, the term "mass spectrum" always relates to the mass-to-charge ratios m/z.

SUMMARY

In accordance with the principles of the invention, an ion guide made of coaxial ring diaphragms is substituted for the conventional multipole rod system to guide the ions in the region where the magnetic field increases. The coaxial rings are connected alternately to the phases of an RF voltage, although it is also possible to use superpositions of several RF voltages across groups of ring diaphragms to increase the mass range. These ring diaphragms are similar to multipole rod systems in that they have pseudopotential distributions which repel the ions radially toward the axis of the ring system. Pseudopotentials are not real potentials; they only describe the time-averaged effect of inhomogeneous RF fields on the ions, which constantly tries to expel ions of both polarities out of the RF field. The effect of the pseudopotential is based on the imposed forced oscillations of the ions in the RF field. In contrast to multipole rod systems, in coaxial ring systems the forced oscillation of the ions in the RF field is imposed not in the direction at right angles to the magnetic field, but predominantly in the direction of the magnetic field lines. Thus, excitation of the cyclotron motion is avoided, even if the cyclotron frequency is the same as the RF frequency over a narrow range.

In another embodiment, the ion guide comprising coaxial ring diaphragms can additionally be supplied with an axial DC electric field to drive the ions forward. Further ion guides can be used outside the ring diaphragm system, for example pole rod systems, although here, as well, measures can be taken to increase the range of guided masses.

The ions which are to be introduced originate from an ion supply outside the magnetic field. This ion supply can be an ion source which continuously delivers ions over a period of time, or a temporary store from which ions can be extracted in portions or in their entirety. The temporary store can also be designed so that it can store ions of a wide mass range.

With a temporary store, the ions can be extracted mass-selectively in a time-controlled manner and sent to the ion storage device (first heavy, then light ions). It is preferable to set the time control so that ions of different masses but the same acceleration energy arrive in the ion storage device at the same time. The mass-selective extraction can be carried out using a grid structure with pseudopotentials, for example; the pseudopotentials being decreased under time control so that they initially admit only heavy ions, then increasingly lighter and lighter ions.

DETAILED DESCRIPTION

While the invention has been shown and described with reference to a number of embodiments thereof, it will be recognized by those skilled in the art that various changes in form and detail may be made herein without departing from the spirit and scope of the invention as defined by the appended claims.

Several measures need to be taken to achieve the objective. The most important and therefore highest-priority measure is to guide the ions of different masses undisturbed through the magnetic field gradient.

The ions are successfully guided in this way by means of an ion guide made of ring diaphragms. This type of ring diaphragm system, onto which an axial DC potential to drive the ions forward can be also superimposed, has already been described in patent specification U.S. Pat. No. 5,572,035 A (J. Franzen). It is operated with an RF voltage whose two phases are usually applied in turn to the ring diaphragms. The electric field lines are aligned largely parallel to the axis in the interior of such a ring diaphragm system, and therefore the RF field causes the ions to oscillate in the direction of the magnetic field lines. Practically no cyclotron motions are excited, even if the cyclotron frequency of the ions coincides with the frequency of the RF voltage. There are weak components of the RF electric field in the radial direction, but these scarcely have any influence if the ions are guided relatively quickly through the increase in the magnetic field.

The form and the strength of the radial pseudopotential in the interior of such a ring system depend on the distance between the ring diaphragms in relation to their internal diameter. In a ring system with closely spaced ring diaphragms, the pseudopotential drops off very quickly toward the axis; depending on their space charge, the ions then collect far from the axis, in front of the inner edges of the ring diaphragms. This effect is undesirable for the guiding of the ions through the magnetic field increase; it is much more favorable to keep the ions on the axis of the ion guide as far as possible.

An arrangement where the ring diaphragms are further apart is better for keeping the ions close to the axis, but this system resembles a series of individual three-dimensional quadrupole ion traps with a very undulating pseudopotential along the axis.

Figure 3:
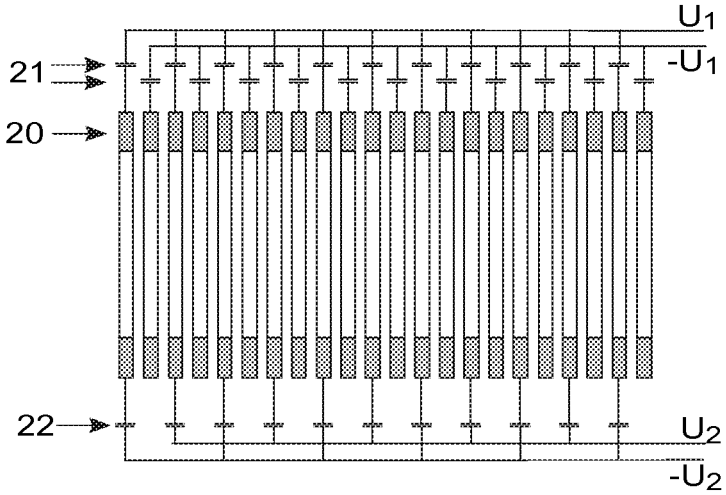
FIG. 3 shows a section of a system comprising closely spaced ring diaphragms (20) with a special type of configuration for the transfer of ions of a wide mass range. In particular, two phases of an RF voltage $U_1$ with relatively low frequency are connected alternately to adjacent ring diaphragms, thus keeping ions of high masses away from the ring diaphragms. This pseudopotential near field is only effective immediately in front of the inner edges of the ring diaphragms. The RF voltage $U_2$ has a higher frequency and both its phases are applied alternately to groups of two ring diaphragms; the pseudopotential of this RF voltage penetrates further toward the axis of the system of ring diaphragms and keeps the lighter ions, in particular, close to the axis. The configuration with capacitors (21, 22) makes it possible to also apply DC voltages to generate a DC gradient to drive the ions forward.

Even if the ring diaphragms are close together it is still possible to keep the ions closer to the axis and at the same time guide heavy ions well. FIG. 3 shows the principle of a ring diaphragm system configured for this purpose. Applying a first RF voltage $U_1$ with medium frequency alternately to the ring diaphragms achieves good guidance of the heavy ions. The pseudopotential is mass- and frequency-dependent; it is inversely proportional to the mass and inversely proportional to the square of the frequency. By applying a second RF voltage $U_2$ with a higher frequency, the phases of which are connected alternately to groups of two neighboring ring diaphragms each, a pseudopotential is generated which penetrates further in the axial direction and keeps particularly the lighter ions close to the axis. Such an ion guide can guide ions of a wide mass range. Such an embodiment where RF voltages of different frequencies are fed to groups of ring diaphragms can also be extended to groups with three or four ring diaphragms each. The frequencies and amplitudes of the individual RF voltages can be adjusted with respect to each other in such a way that ions of an optimal mass range are guided.

Instead of a system of ring diaphragms, it is also possible to use a double helix, as is also described in the patent specification U.S. Pat. No. 5,572,035 A. Although the double helix exhibits small radial components of its electric field lines, it is still greatly better for guiding ions through the magnetic field gradient than rod systems.

Figure 1:
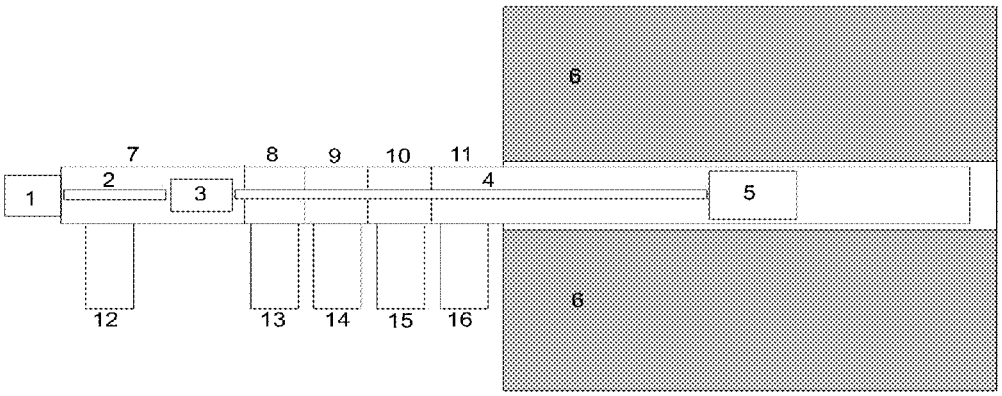
FIG. 1 (PRIOR ART)
FIG. 1 is a schematic representation of an ion cyclotron resonance mass spectrometer (ICR-MS) according to the prior art. Ions from an ion source (1) are guided by an ion guide (2) into a temporary store (3) and from there by a further ion guide (4) into the measuring cell (5), which is located inside the bore of a magnet system (6), enclosed by a vacuum recipient (11). In order to generate an ultrahigh vacuum, the vacuum system is divided into chambers (7, 8, 9, 10 and 11), which are differentially evacuated by pumps (12, 13, 14, 15 and 16).
Figure 2:
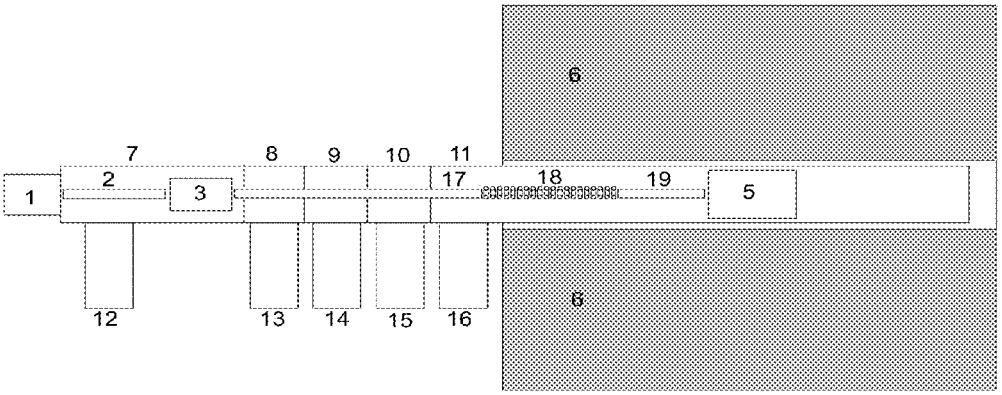
FIG. 2 is likewise a schematic representation of an ICR-MS according to this invention, in which the ion guide (4) has been replaced by two ion guides (17) and (19) of the conventional type, between which the system of ring diaphragms (18) according to the invention is located. The system of ring diaphragms (18) is located in the region of greatest increase in the magnetic field and makes it possible to transfer ions of a wide mass range true-to-quantity into the measuring cell.
Figure 4:
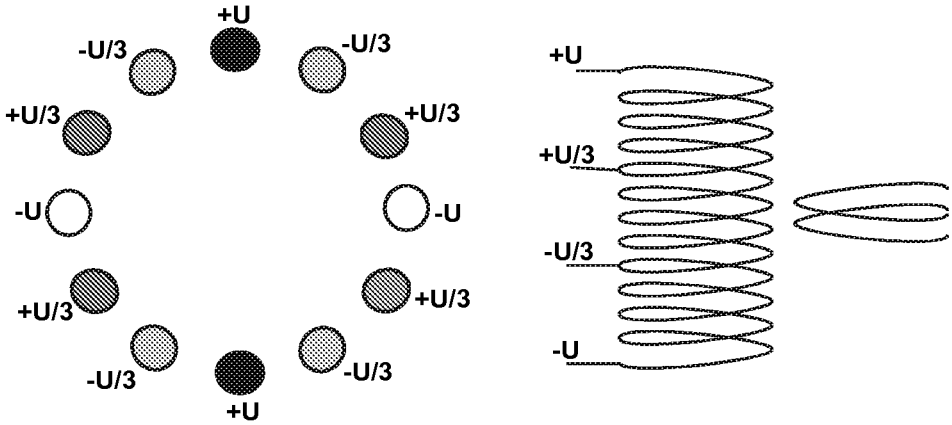
FIG. 4 is a schematic representation of a cross-section through a dodecapole rod system and a transformer for generating the RF, with a special configuration to guide ions of a wide range of masses close to the axis.

In order to achieve the objective of this invention well, the ion guides (17) and (19) of FIG. 2 must also be designed so as to guide ions of a wide mass range efficiently. If simpler pole rod systems are to be used, this can be achieved by means of a specially configured dodecapole rod system according to FIG. 4, for example. Close to the axis, this system provides a quadrupole-like pseudopotential, with its advantageous guiding of light ions, in contrast to a conventional dodecapole system with alternately applied phases of an RF voltage. Far from the axis, in front of the pole rods, on the other hand, the heavy ions are held back well; much more efficiently than with a quadrupole rod system. Since the ion guide (17) begins in a region where the pressure is above approx. 0.01 Pascal, the kinetic energies of the ions are removed sufficiently by collisions for the ions to collect close to the axis. The dodecapole system described collects light ions on the axis itself, while heavier ions are collected around the light ions. This arrangement of the ions is largely maintained when the ions enter a region of very good vacuum after the differential pumping chambers.

In order to achieve highly efficient utilization of the ions, they must be collected in a temporary store. The collection can also extend temporally over the measuring phases of the ICR measuring cell, and therefore encompass practically all ions supplied by an ion source. The temporary store must, however, be designed so that it can store ions of a wide mass range. For example, a normal quadrupole storage device can only store ions over a mass range of approx. 1:20; this is too small by far. In higher multipole rod systems, which can be used as storage devices, ions of a far wider mass range are stored. However, the ions are not stored on axis, but predominantly close to the pole rods. This makes it more difficult to extract the ions close to the axis.

Figure 5:
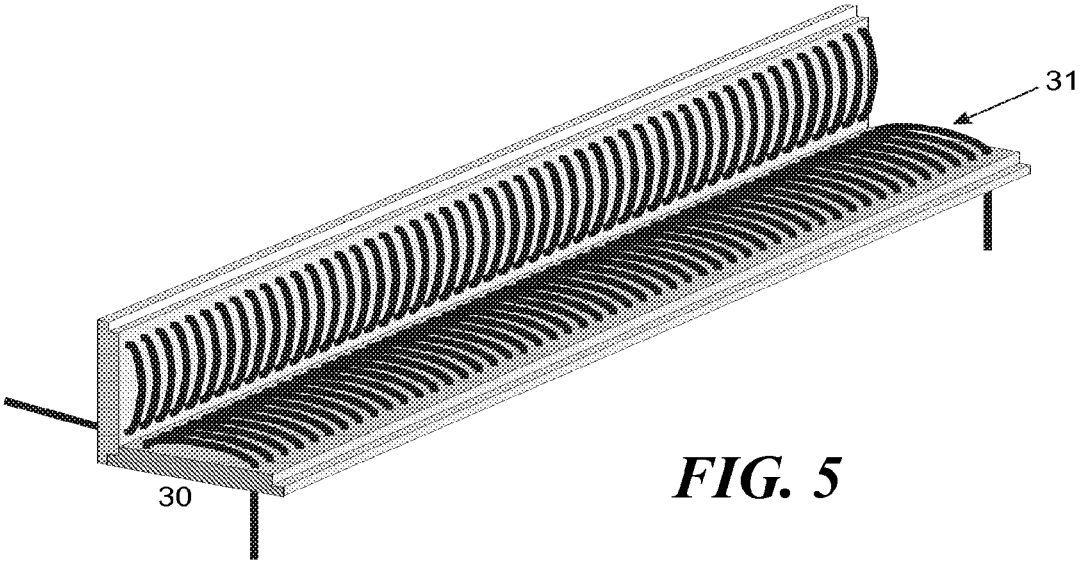
FIG. 5 shows a partial cutaway view including two of the four sides of a square wire loop system which can serve as a temporary store with a storage capability for ions of a high mass range. The rows (31) of wire loops are embedded in ceramic plates (30). RF voltages of the same phase but different amplitude are applied to adjacent wire loops in each row. As an RF dipole grid field, these RF voltages generate a pseudopotential near field which keeps heavy ions away from the wire loops. The averaged RF voltages, which are applied crosswise to the four rows of wire loops, generate a quadrupole field and keep light ions in the axis of the system.

There are several embodiments for ion storage devices which store ions of a wide mass range and at the same time collect ions close to the axis. An example of such an ion storage device is shown in FIG. 5, where a view into the interior of the ion storage device is made possible by omitting two of the four wall elements in the drawing. The storage device consists of four wall elements made of insulating material, preferably ceramic, into each of which a row of wire loops has been embedded. Electric circuits can be mounted on the back of the wall elements to supply the wire loops with the necessary RF and DC voltages. The electric circuits can be printed or vacuum-deposited and be equipped with the necessary electronic components.

The four rows of wire loops are supplied crosswise with the two phases of an RF voltage; this generates a quadrupole field close to the axis, which collects the ions on axis. Since such a quadrupole field has only very small focusing power for heavy ions, these must be kept in the storage device in a particular way. This is achieved by applying an RF voltage of the same frequency but different amplitude to adjacent wire loops of the same row. This generates a dipole grid with a short-range pseudopotential, i.e., a near field, which repels heavy ions. By selecting the amplitudes appropriately, the near field and the quadrupole field can be adjusted with respect to each other so that ions of an optimum mass range remain stored. The quadrupole field in this case is generated by the averaged RF voltages across the rows of wire loops. It is, however, also possible to select RF voltages with different frequencies for the near field and the quadrupole field. The RF voltages then have a different effect on ions of different masses.

This requires there to be a collision gas in the temporary store which removes the kinetic energy of the ions because, otherwise, light ions straying into the near field experience accelerations which catapult them out of the storage device. The lower mass limit for storage is considerably higher for the near field than for the quadrupole field.

Other storage systems which collect ions on axis can also be constructed as pole rod systems, for example. It is thus possible to generate both a central quadrupole field and also stronger repulsive pseudopotentials in front of the rods by using appropriate configurations in a multirod system, similar to the situation in the dodecapole system of FIG. 4.

The problem which still remains to be solved is how to ensure that the ions of all masses arrive at the ion storage device at the same time. This problem can be solved, for example, by first extracting the heavier ions from the temporary store and sending them to the ion storage device, then increasingly lighter and lighter ions, and to time this so that ions of all masses arrive at the ion storage device at the same time. This method of extracting first heavier ions, then increasingly lighter ions can be achieved by using an adjustable high-pass filter for ions. The temporary store must only be filled to the level necessary to fill the ion storage device in the strong magnetic field because the temporary store is completely emptied each time. It is therefore expedient to fill the temporary store (3) with a sufficient quantity of ions from an upstream initial storage system, for instance the ion guide (2) in FIG. 2.

The high-pass filter required can be realized by a pseudopotential barrier, for example. A pseudopotential is mass-dependent; its effect is inversely proportional to the mass of the ions. A pseudopotential barrier therefore allows ions above a certain adjustable mass limit to pass and holds back lighter ions.

Figure 6:
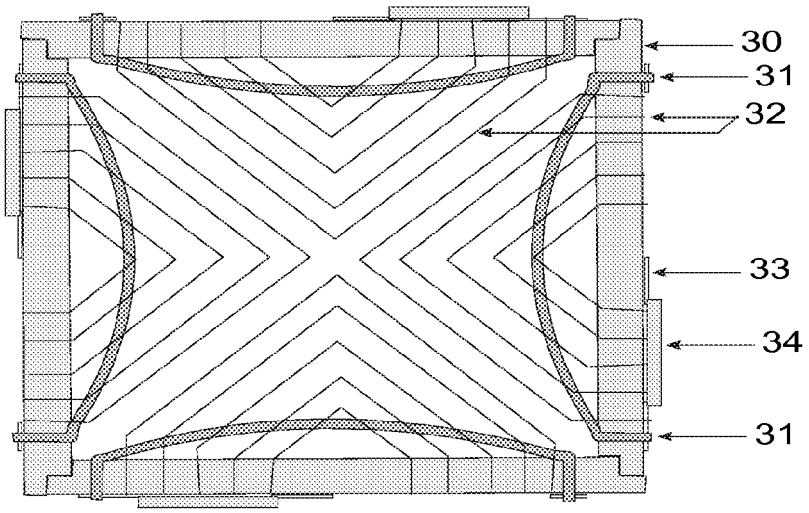
FIG. 6 shows a wire loop system according to FIG. 5 which is terminated with grid wires (32), which generate a pseudopotential barrier for the ions in the temporary store by the application of the two phases of an RF voltage. Rows of wire loops (31) are embedded in a total of four ceramic plates (30) and are supplied with voltages by printed circuits (33) with electronic components (34). Decreasing the RF voltage across the grid wires (32) allows the time-controlled emergence first of heavy ions, then of increasingly lighter ions, from the temporary store and allows them to be accelerated and sent in the direction of the measuring cell. This makes it possible for all the ions of the temporary store to reach the measuring cell simultaneously despite their different masses.

A pseudopotential barrier can be produced, for example, by an exit grid, such as a Bradbury-Nielsen shutter, the grid wires of which alternately carry the two phases of an RF voltage. Only ions with masses higher than an adjustable mass threshold can pass through the exit grid. The ions pass the troughs of the pseudopotential between the grid wires; they cannot come into contact with the grid wires themselves. It is expedient if the ions are pushed against the exit grid by an axial DC voltage gradient inside the temporary store. Such a voltage gradient can easily be generated in a temporary store according to FIG. 5. Decreasing the amplitude of the RF voltage at the exit grid allows increasingly lighter ions to pass though. With such a device it is therefore possible to achieve the desired effect of making the ions flow out in the sequence of heavy to lighter ions under time control. FIG. 6 shows a somewhat unusual exit grid at the end of an ion storage device according to FIG. 5, which can be used to solve the problem described. The time control requires specially developed electronics to generate the RF voltage with time-controlled amplitudes. The time control of the amplitude can easily be adjusted by a skilled experimenter to ensure that, with a given intermediate acceleration of the ions, the ions of all masses enter the ion storage device in the strong magnetic field simultaneously.

The desired effect of simultaneous arrival of the ions can also be achieved by discharging all ions simultaneously from the temporary store and re-arranging the ions in flight. Their mass-dependent flight velocity can be reversed by so-called "bunching", for example. They therefore reach a certain point at the same time but with different energies. Using a second, decelerating, bunching one can ensure that ions of all masses again arrive at a point simultaneously, but this time with the same energy. This somewhat difficult operation will not be discussed further here.

This invention gives those skilled in the art a collection of instrumental devices and methods for the optimum storage of ions of a wide mass range in an ion storage device in a strong magnetic field.

What is claimed is:

1. An apparatus for introducing ions into a space-restricted magnetic field in a direction of magnetic field lines of the magnetic field, the ions being generated in an ion supply located outside the magnetic field and being transported to an ion storage device located inside the magnetic field; the apparatus comprising:

an ion guide having a plurality of coaxial ring diaphragms, each diaphragm having an axis parallel to the direction of magnetic field lines and being located in a region of greatest increase in the magnetic field between the ion supply and the ion storage device;

an RF generator for generating RF voltages with at least two phases, the RF voltages being applied to plurality of ring diaphragms so that in the direction of magnetic field lines the ring diaphragms are connected to RF voltages with alternating phases;

a first non-trapping multipole ion guide positioned adjacent to the ring diaphragm ion guide to guide the ions from the ion supply into the ring diaphragm ion guide; and a second non-trapping multipole ion guide positioned adjacent to the ring diaphragm ion guide to guide the ions from the ring diaphragm ion guide into the ion storage device.

2. The apparatus of claim 1, further comprising a DC voltage generator connected to the plurality of ring diaphragms in order to supply the ring diaphragms with DC potentials so that the ions are driven in the direction of the magnetic field lines towards the ion storage device.

3. The apparatus of claim 1, wherein the RF generator comprises means for generating a plurality of RF voltages with different frequencies, wherein the RF voltages are connected alternately to different groups of ring diaphragms, each group comprising a number of neighboring ring diaphragms so that the mass range of guided ions is increased.

4. The apparatus of claim 1, further comprising a device for accelerating ions exiting the ion supply and a device for decelerating ions entering the ion storage device.

5. The apparatus of claim 1, comprising a mass-selective extraction device for extracting ions from the ion supply and a mechanism for controlling the mass selective extraction device to sequentially extract ions from the ion supply starting with ions having a highest mass and proceeding to ions having a lowest mass, so that ions of all masses reach the ion storage device at substantially a same time.

6. The apparatus of claim 5, wherein the mass selective extraction device comprises a pseudopotential barrier having a magnitude, which under control of the mechanism for controlling the mass selective extraction device, can be reduced over time so that ions leave the ion supply mass-sequentially starting with ions having a highest mass and proceeding to ions having a lowest mass.

7. An apparatus for introducing ions into a space-restricted magnetic field in a direction of magnetic field lines of the magnetic field, the ions being generated in an ion supply located outside the magnetic field and being transported to an ion storage device located inside the magnetic field; the apparatus comprising:

an ion guide located in a region of greatest increase in the magnetic field between the ion supply and the ion storage device and having a pair of wires, each wire being wound in a helix with an axis parallel to the direction of the magnetic field lines, the wires being interspersed to form a double helix in the region; and an RF generator for generating two RF voltages having different phases, one RF voltage being connected to one of the two wires and the other RF voltage being connected to another of the two wires;

a first non-trapping multipole ion guide located adjacent to the wire ion guide to guide the ions from the ion supply into the wire ion guide; and a second non-trapping multipole ion guide located adjacent to the wire ion guide to guide the ions from the wire ion guide into the ion storage device.

* * * * *